US007490562B2

(12) United States Patent
Cornilleau

(10) Patent No.: US 7,490,562 B2
(45) Date of Patent: Feb. 17, 2009

(54) FOLDING TABLE TENNIS TABLE

(75) Inventor: Pierre Cornilleau, Bonneuil les Eaux (FR)

(73) Assignee: Etablissements Cornilleau, Bonneuil les Eaux (FR)

( * ) Notice: Subject to any disclaimer, the term of this patent is extended or adjusted under 35 U.S.C. 154(b) by 284 days.

(21) Appl. No.: 10/790,778

(22) Filed: Mar. 3, 2004

(65) Prior Publication Data

US 2005/0197215 A1 Sep. 8, 2005

(51) Int. Cl.
*A47B 3/083* (2006.01)

(52) U.S. Cl. ..... 108/168; 108/170

(58) Field of Classification Search ..... 108/166, 108/167, 168, 169, 170, 171, 172, 173, 174, 108/175, 115; 473/496; 292/340, 32, 39; 312/25, 27; 248/371
See application file for complete search history.

(56) References Cited

U.S. PATENT DOCUMENTS 1,108,873 A * 8/1914 Methven ..... 292/340
2,431,105 A * 11/1947 Brinson ..... 292/172
4,027,600 A * 6/1977 Mueller ..... 108/169
4,120,249 A * 10/1978 Blink et al. ..... 108/174
4,133,271 A * 1/1979 Carlson ..... 108/174
5,531,493 A * 7/1996 Reynolds ..... 292/32
5,865,479 A * 2/1999 Viney ..... 292/39
6,321,664 B1 * 11/2001 Damour et al. ..... 108/168
6,425,835 B1 7/2002 Kettler
6,478,345 B1 * 11/2002 Viney ..... 292/39

FOREIGN PATENT DOCUMENTS

DE 299 01 458 6/1999
FR 2 729 302 7/1996
FR 2729302 A1 * 7/1996
FR 2747280 * 10/1997
WO WO03/026461 * 4/2003

* cited by examiner

*Primary Examiner*—José V Chen
*Assistant Examiner*—Matthew W Ing
(74) *Attorney, Agent, or Firm*—Young & Thompson

(57) ABSTRACT

A folding table tennis table comprising a support, two table tops that are movable relative to the support between a horizontal position and a vertical position, each table top cooperating with the support to form a structure of configuration that is reversibly foldable between an unfolded state corresponding to the horizontal position of the table top and a folded state corresponding to the vertical position of the table top, which structure includes a retractable lock to lock it in at least one of the two states. The foldable structure includes an abutment that engages when its configuration comes close to a configuration corresponding to a locked state, thereby opposing reversibility in that configuration.

8 Claims, 3 Drawing Sheets

FOLDING TABLE TENNIS TABLE

BACKGROUND OF THE INVENTION

Folding table tennis tables are well known: they comprise two table tops connected in hinged manner to a support by levers in such a manner that each table top can take up two positions, namely a vertical position, in particular for storage, and a horizontal position.

There are several linkages in existence for connecting the table tops to the support via hinged levers or arms of shapes adapted to some particular action for folding/unfolding movements.

In order to make a table more compact when in its storage stage, i.e. in the folded state, mechanisms have been sought that enable the table tops to be put into a vertical position in which they are practically face against face or in any event as close together as possible, and in which they are as low down as possible so that the center of the gravity of the assembly is as low as possible in order to obtain maximum stability for the folded table.

In order to achieve this objective, it is necessary for the edge of each table top adjacent to the net when the table is in its playing state to be capable of changing its height, which means that it is not possible for the table top to be connected at said edge to a fixed position on the support. It is also known to make use of locking means serving to stiffen the unfoldable structure by locking together two of the elements constituting said structure (including the support and each of the table tops). Such means can be provided in sufficient number and/or distribution to ensure that the structure is made rigid when the table is in its playing state or in its storage state.

When handling the table, it is possible for the folding or unfolding movements to be performed incompletely, with the structure failing to reach either one of its states in which the locking effect for making it rigid becomes effective. Such failure to complete the movements may not be noticed by the user who believes the structure is locked when, in fact, it is not. The table can thus either unfold spontaneously, or under the effect of a load in the vicinity of the net, can begin a folding movement. It will be understood that untimely opening of the folding table can injure a nearby user. It will also be understood that if the load on an open table is a child, the child might slide between the two table tops, at least one of them tipping under the child's weight, and subsequently tending to drop back to a horizontal position, severely injuring the child by pinching between the two table tops.

OBJECTS AND SUMMARY OF THE INVENTION

There thus exists a need to fit a folding table tennis table with safety means for preventing such accidents arising.

To this end, the invention provides a folding table tennis table comprising a support, two table tops that are movable relative to the support between a horizontal position and a vertical position, each table top co-operating with the support to form a structure of configuration that is reversibly foldable between an unfolded state corresponding to the horizontal position of the table top and a folded state corresponding to the vertical position of the table top, which structure includes retractable locking means to lock it in at least one of said two states.

According to a characteristic of the invention, the foldable structure includes abutment means that engage when its configuration comes close to a configuration corresponding to a locked state, thereby opposing reversibility in said configuration. These abutment means provide safety by preventing a table spontaneously folding or deploying even when its locking means are not effective.

In preferred manner, the abutment means are arranged to engage when the configuration of the foldable structure comes close both to its folded state and to its unfolded state.

In an embodiment of the invention, each table top is provided with a finger projecting from each of its side edges and engaged in a corresponding guiding slideway secured to the support and extending in a generally vertical direction, and in which the above-mentioned locking means comprise, on each side edge of the table top, a bolt of axis perpendicular to said side edge and urged resiliently along its axis towards the support, which support presents a recess facing each side edge and forming a catch for receiving the corresponding bolt when the structure is in at least one of its two above-mentioned states. The abutment means comprise the bolt and a secondary recess in the support, defined beside the catch by a wall over which the bolt can slide, and at its end remote from the catch by a shoulder for stopping the bolt. When made in this way, the abutment means do not prevent continued movement of the table top towards the locked state, but, when a folding or unfolding movement of the table has not been fully completed, they do oppose movement in the direction opposite to the folding or unfolding of the table.

In order to guarantee such safety both when unfolding and when folding the table, the support presents another recess forming a catch for receiving the corresponding bolt when the structure is in its other state and the abutment means comprise the bolt and another secondary recess in the support, defined beside the other catch by a wall over which the bolt can slide, and at its end remote from said other catch by a shoulder for stopping the bolt.

In this embodiment, and more precisely still, each finger is in the form of a bushing, each bolt being slidably mounted inside the finger, and each catch and secondary recess associated with said bolt being located in the bottom of the slideway associated with said finger. It is thus possible to implement means for actuating the locking and abutment means against their resilient return, said means comprising a link connected to each bolt and extending along the bottom face of the table top, together with pull means acting on the link and extending to the vicinity of the outside end of the table top.

The link connected to each bolt is a rod made integrally with the bolt and is provided at its end remote from the bolt with a rack, while the pull means comprise a rod slidably mounted under the table top and provided at its end adjacent to the outside end of the table top with a handle and at its opposite end with a rack that co-operates with a pinion meshing with the rack of the rod of each bolt. The pinion is mounted to turn in a housing for guiding the above-mentioned racks, the thickness of the pinion being not less than the sum of the widths of the racks. Finally, the housing possesses means for being fixed to the frame of the table top, in particular on the cross-member of the frame forming the edge of the table top adjacent to the net.

BRIEF DESCRIPTION OF THE DRAWINGS

Other characteristics and advantages of the invention appear from the following description of various embodiments.

Reference is made to the accompanying drawings, in which.

MORE DETAILED DESCRIPTION

Figure 1:
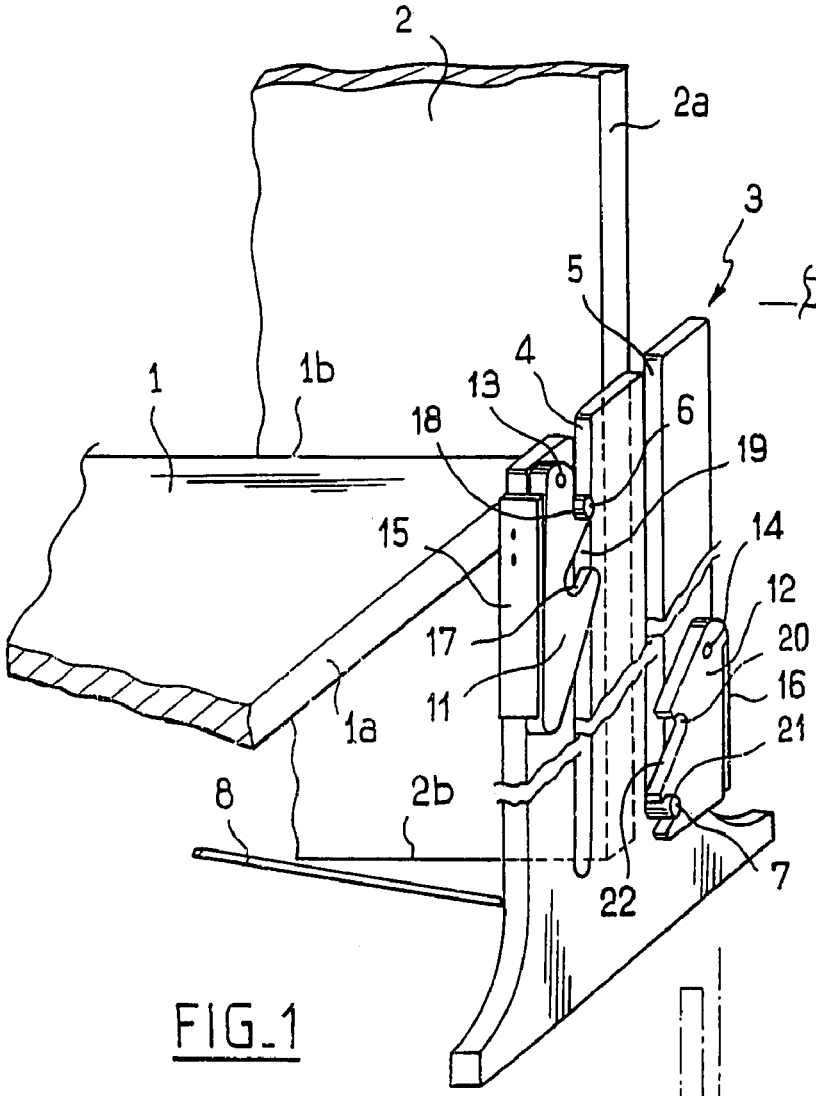
FIG. 1 is a simplified view of a folding table tennis table fitted with means of the invention.

FIG. 1 shows part of a folding table tennis table. The table comprises two table tops 1, 2, the table top 1 being in its playing state and the table top 2 being in its storage state. Each of the table tops is connected to a general support which in this figure comprises two middle side uprights 3 braced by means that are not shown, each upright having sliding slots 4, 5 for guide fingers 6, 7 of the table tops 1 and 2 that project from their side edges 1*a*, 2*a* in the vicinity of the edges 1*b*, 2*b* of the table tops that are close to the center of the table, i.e. to the net when the table top is in its playing state.

In conventional manner, arms such as 8 are hinged between each of the table tops and each of the uprights of the support.

Figure 3:
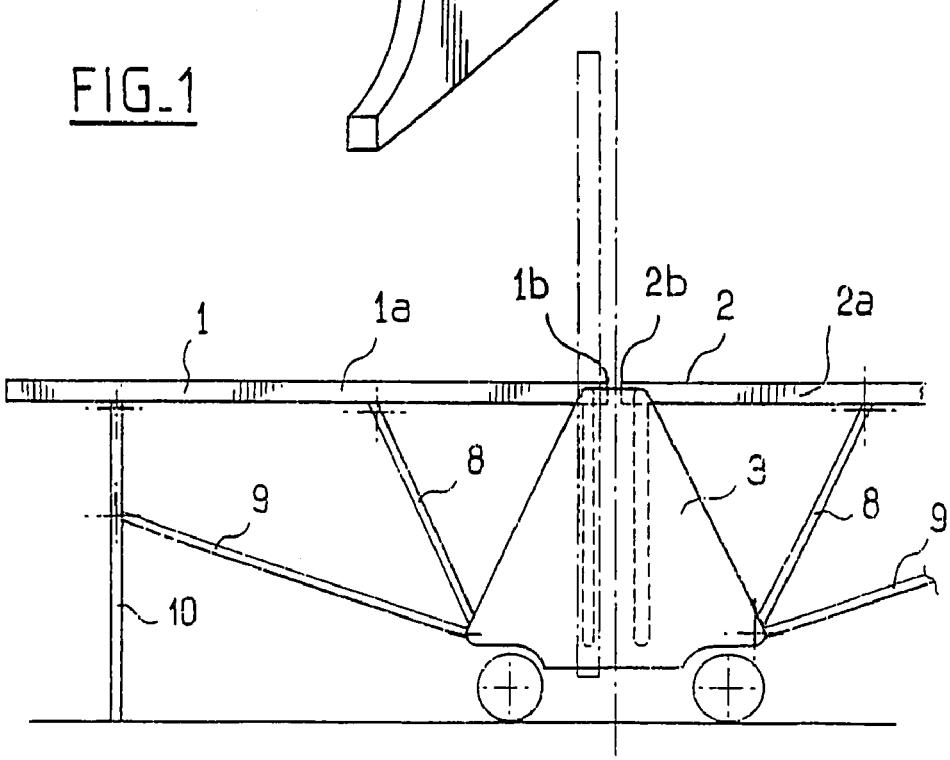
FIG. 3 is a simplified view of a folding table showing the preferred embodiment of the invention.
Figure 5:
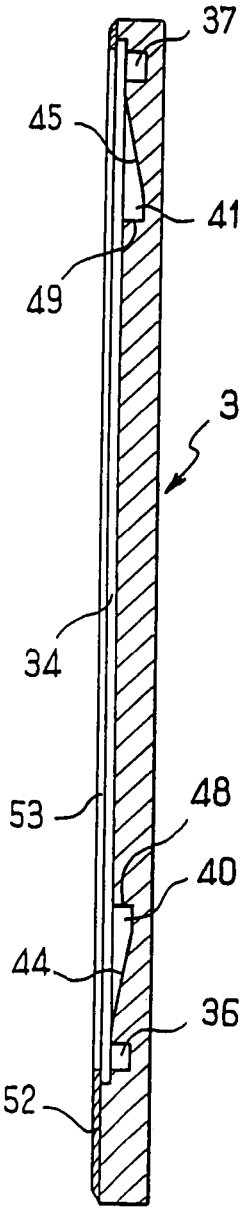
FIG. 5 is a section view on line V—V of FIG. 4.

FIG. 3 shows a structure similar to that of FIG. 1, in which the elements described above are given the same references, and in which other components can be seen such as levers 9 and a foldable rear leg 10 which belongs to the structure of foldable configuration that is constituted by the folding table.

In FIG. 1, each upright 3 has beside each of its slots 4 and 5 a top pawl 11 and a bottom pawl 12. The figure shows only the top pawl associated with the slot 4 and the bottom pawl associated with the slot 5. Each of these pawls is in the form of a lever hinged about a horizontal axis 13, 14 and it is urged towards the corresponding slot by a resilient member represented in the figure as a spring blade 15, 16. The top pawls 11 have two notches 17, 18 interfering with the guide slot 4 and facing upwards. The bottom notch 17 constitutes an abutment preventing the portion of the finger 6 which extends beyond the upright 3 from running downwards along the slot 4 when it has not been able to reach the notch 18. In contrast, the finger 6 can continue to travel upwards along the slot 4, sliding over the sloping wall 19 of the pawl 11 so as to cause it to retract against the spring blade 15 and thus reaching the notch 18 which constitutes the catch for locking the table top 1 in the horizontal position. Symmetrically, the pawl 12 has two notches 20, 21 that face downwards, the first constituting an abutment preventing the table top 2 from folding down while the finger 7 is received therein, and the second 21 constituting a catch for locking the table top 2 in the vertical position. The sloping surface 22 situated between the two notches enables the finger 7 to reach the catch 21.

Figure 2:
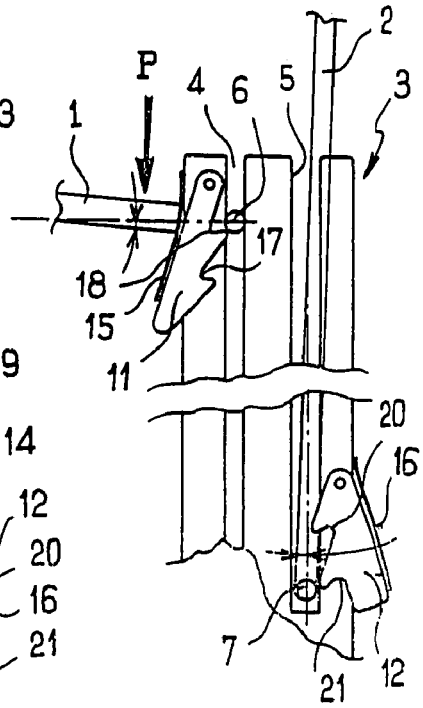
FIG. 2 is a fragmentary side view of FIG. 1 when the table tops are not in their locked position.

FIG. 2 shows a dangerous position for each of the table tops 1 and 2. The finger 6 secured to the table top 1 has not reached the catch 18, for example because the legs 10 of this table top are standing on ground that is not horizontal or that presents an obstacle in just the right place to prevent the table top 1 from reaching its horizontal position. It will be understood that under the effect of a load P there is nothing to prevent the finger 6 from sliding down the slot 4 other than the notch 17 of the pawl 11, which constitutes a safety catch limiting the extent to which the panel 1 can fold up. Similarly, but in inverse manner, FIG. 2 shows the unstable position of the table top 2 which has not quite reached its vertical position where the finger 7 would be locked by the catch 21, such that there is nothing to prevent the finger 7 from sliding back up the slot 5 during tilting of the table top 2, other than the notch 20 of the pawl 12 intercepting it.

The safety means shown in FIGS. 1 and 2 are shown in diagrammatic manner so as to illustrate the general function of the means of the invention which is to prevent the configuration of the foldable structure formed by the table tops, the support, and the levers of a folding table tennis table being reversible when its configuration comes close to the table top being in a folded state or an unfolded state. It would not go beyond the ambit of the invention to provide such pawls or analogous members at the hinges between the levers 8 or 9 with the table top 1 or with the leg 10, for example.

Figure 4:
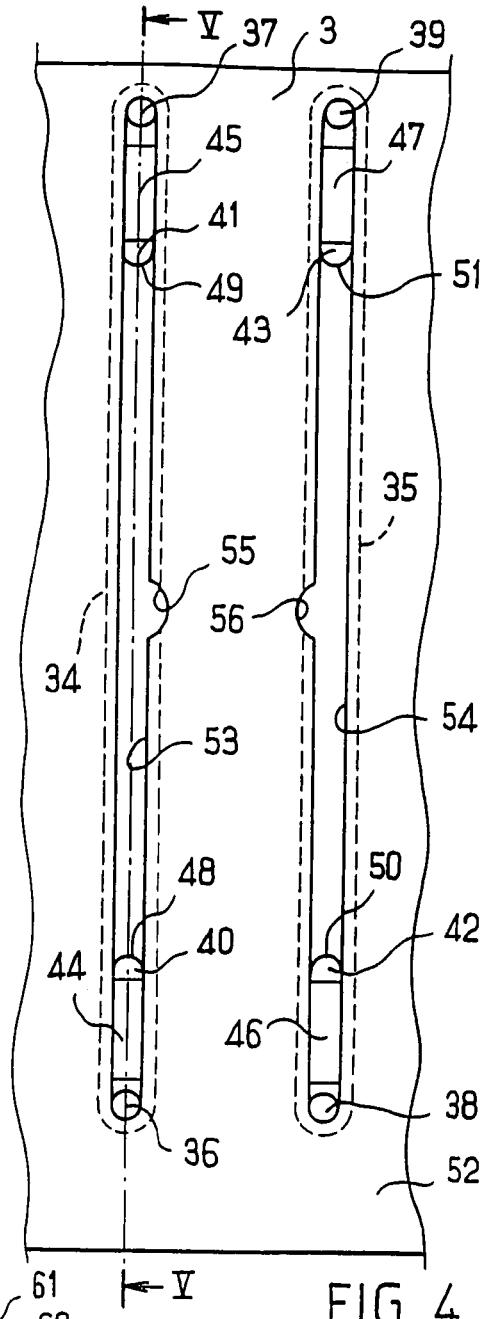
FIG. 4 is a view of the inside face of the support of the table of the invention.

FIG. 4 shows part of the inside face of the upright 3 of the FIG. 3 table. Instead of the slots 4 and 5 that pass right through the upright 3 as shown in FIGS. 1 and 2, the inside face of this upright is hollowed out by two vertical grooves 34 and 35. At each of its ends, the bottom of each groove has a blind orifice 36, 37, 38, 39 and a recess 40, 41, 42, 43 defined by a wall 44, 45, 46, 47 sloping towards the adjacent blind orifice, and by an abrupt wall 48, 49, 50, 51 remote from said orifice. This hollowed-out face is covered by a plate 52 provided with two openings 53, 54 that are narrower than the grooves 34 and 35 except in their middle portions where said openings are enlarged at 55 and 56. The grooves and the plate thus define two guiding slideways that perform the same function as the slots 4 and 5 of the preceding figures.

Figure 6:
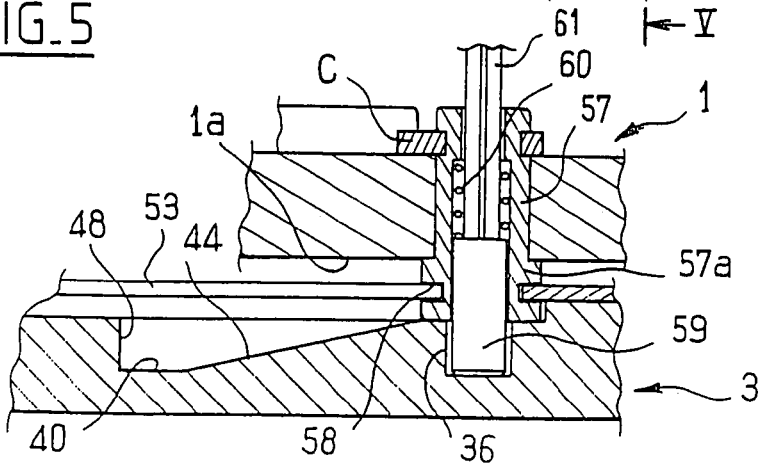
FIG. 6 is a section view of a detail of the locking and abutment means of the deformable structure of the table of the invention.

As shown in FIG. 6, each of these openings 53, 54 forms a slideway for the head 57*a* provided with a groove 58 and located on a finger 57 carried by a side edge such as 1*a* of the table top 1. In conventional manner, the side edge 1*a* of the table top 1 is in fact the outside surface of a longitudinally-extending member situated beneath the playing surface of the table top, in which the finger 57 is a force-fit, and behind which it is blocked by a load-carrying key C, e.g. by catches forming a bayonet fitting with the finger 57. The finger 57 is hollow, forming a bushing, with a bolt 59 being received therein and urged towards the upright 3 by a spring 60. The enlarged portions 55 and 56 in the openings 53 and 54 enable the head of the finger 57 with its groove 57*a* to be engaged in the slideways. Under the effect of the spring 60, it will be understood that the bolt 59 is pressed against the bottom of the corresponding groove 34, 35 and that as a function of its position it is capable of dropping into the blind orifices 36, 37, 38, 39 that form locking catches for holding the corresponding table top in one or the other of its horizontal or vertical positions relative to the support, and also in the secondary recesses such as 40 that constitute safety catches in accordance with the invention. It will be understood on looking at FIG. 6 that when the bolt 59 is in the recess 40, the table top 1 can continue to move into the locked state with the slope 44 acting as a camming surface for pushing the bolt back into the bushing 57, whereas the bolt 59 comes into abutment the abrupt wall 48 of the housing 40 so as to prevent the table top 1 from moving in the opposite direction, thus ensuring that the configuration of the foldable structure is no longer reversible once it has reached the vicinity of the catch 36 or any of the above-described catches.

Figure 7:
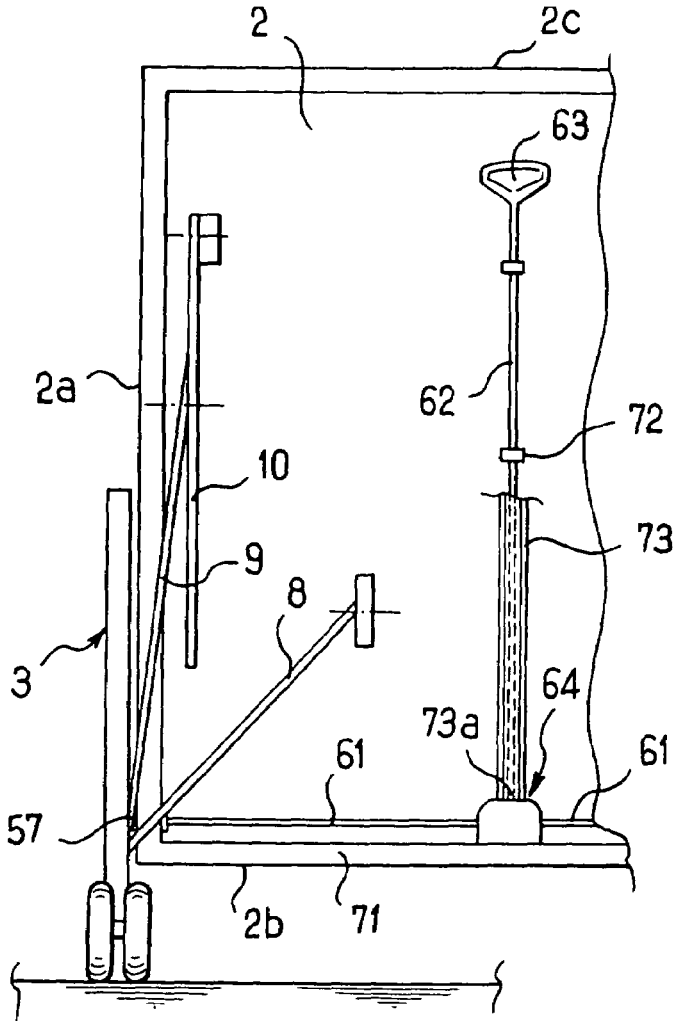
FIG. 7 is a simplified view of the bottom face of a folding table top in the storage position.
Figure 8:
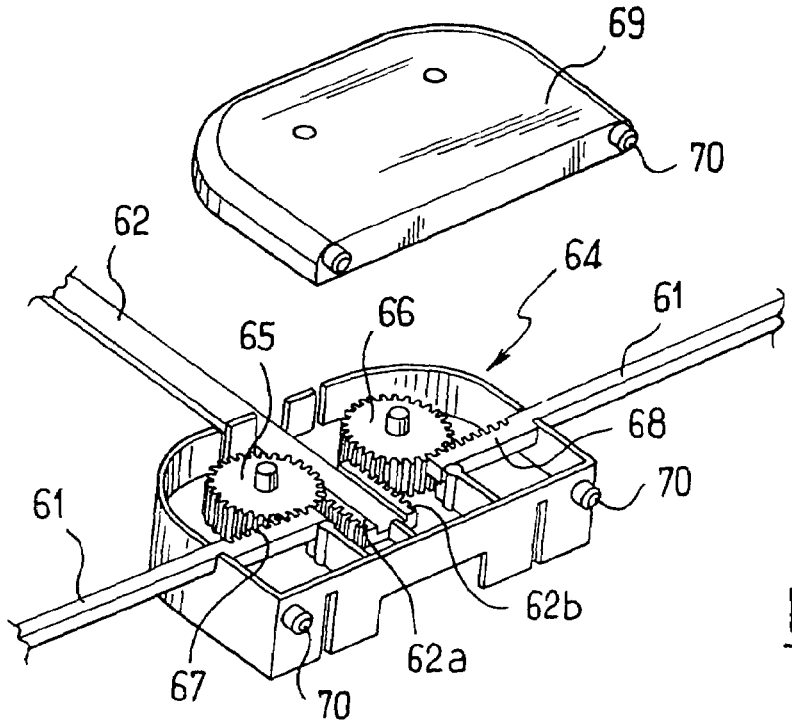
FIG. 8 is a detail view of means for driving the locking and safety members of the table shown in FIGS. 3 to 7.

In FIG. 6, it can be seen that the bolt 59 is extended by a rod 61 which extends under the table top 2 (see FIG. 7) so as to reach the middle portion in the vicinity of the edge 26 of said table top that is adjacent to the net when the table is in the plane position. This rod 61 constitutes a member for driving the bolt 59 to extract it from the catches and the recesses in which it can be received. The rod 61 is actuated by a pull rod 62 provided with a handle 63 situated close to the end edge 2*c* of each table top, i.e. its edge that is furthest from the net. Co-operation between the rods 61 and the rod 62 takes place via a deflector housing shown in FIG. 8. The housing 64 carries two rotary pinions 65 and 66 meshing with respective opposite racks 62*a* and 62*b* formed at the end of the rod 62 remote from the handle 63. Each rod 61 is of polygonal section to prevent it turning about its own axis and is fitted at its end remote from the bolt 59 with its own rack 67, 68. This rack meshes with a corresponding one of the wheels 65, 66, and to avoid interfering with the racks 62*a*, 62*b*, the pinions 65 and 66 are of thickness such that the level at which the rods 61 mesh is in a plane different from the level at which the rod 62 meshes. The relative disposition of the racks is such that movement to extract the rod 62 from the housing 64 causes the pinions 65 and 66 to turn in the direction that causes the rods 61 to penetrate into the housing 64. Thus, by pulling the handle 63 towards the outside edge of a table top, each bolt 59 is caused to retract into its finger 57, thereby unlocking or inhibiting the safety mechanism of the corresponding table top. The housing 64 is provided with a lid 69 and means 70 for fixing it to the middle of the cross-member 71 of each table top defining the edge 1*b* or 2*b* thereof, under the playing surface. The rod 62 is retained slidably either in staples 72 fixed under the playing surface of each table top or, as shown in part, inside a cover 73 which covers the entire rod 62. The end 73*a* of the cover constitutes means for fixing the housing 64 via its lid 69.

The advantage of this cover lies in the barrier that it constitutes against access to the rod 62 which can then be manipulated only by the handle 63 which is located out of the reach of children when the table is in the folded position. Centralized manual control of unlocking and inhibiting the safety mechanism of each table top is thus achieved, thereby making the operations of folding and unfolding the table tennis table easier.

What is claimed is:

1. A folding table tennis table comprising a rigid support, two table tops that are movable relative to said support between a horizontal position and a vertical position, each table top co-operating with the support to form a structure of configuration that is reversibly foldable between an unfolded state which is the horizontal position of the table top and a folded state which is the vertical position of the table top, which structure comprises retractable locking means including a movable bolt to lock said structure in at least said folded state, wherein the foldable structure includes abutment means comprising said bolt and a shoulder which are engaged when the structure reverses from a position of the table top near said folded state towards said horizontal position of said table top, thereby opposing reversibility of the structure to continue, and wherein each table top is provided with a finger projecting from each side edge of said table top and engaged in a corresponding guiding slideway secured to the support and extending in a substantially vertical direction, and with, on each side edge of the table top, said bolt having an axis perpendicular to said side edge and urged resiliently along its axis towards the support, which support presents a recess facing each side edge and forming a catch for receiving said bolt when the structure is in at least one of said folded state or said unfolded state, wherein said shoulder for stopping the bolt is defined by one end of a secondary recess in the support, remote from the catch, said recess defining beside the catch a wall over which the bolt can slide.

2. A table according to claim 1, wherein the support presents another recess forming a second catch for receiving the corresponding bolt when the structure is in the other of said folded state and said unfolded state and wherein the abutment means comprise the bolt and another secondary recess in the support, defined beside the second catch by a second wall over which the bolt can slide, and at an end remote from said second catch by a second shoulder for stopping the bolt.

3. A table according to claim 1, wherein each finger is in the form of a bushing, each bolt being slidably mounted inside the finger, and each catch and secondary recess associated with said bolt being located in the bottom of the slideway associated with said finger.

4. A table according to claim 1, wherein the locking and abutment means of each structure include means for actuating each of said locking and abutment means against their resilient return means, said means for actuating comprising a link connected to each bolt and extending along the bottom face of the table top, and pull means for applying traction to said link and extending to the vicinity of the outside end of the table top.

5. A table according to claim 4, wherein the link connected to each bolt is a pull rod made integrally with the bolt and is provided at its end remote from the bolt with a first rack, while the pull means comprise a rod slidably mounted under the table top, wherein said pull rod comprises a first an outside end adjacent to end of the table top and provided with a handle said pull rod further comprising an opposite end with a second rack that co-operates with a pinion meshing with the first rack of the rod of each bolt.

6. A table according to claim 5, wherein the pinion is mounted to turn in a housing for guiding the first rack and the second rack, the thickness of the pinion being not less than the sum of the widths of said first rack and said secon rack.

7. A table according to claim 6, wherein the housing possesses means for fixing said housing to a cross member forming the end edge of the table top adjacent to the net when the table is in the playing position.

8. A table according to claim 7, wherein the pull rod is received under a cover extending between the pinion and the handle.

* * * * *